United States Patent [19]

Murakami et al.

[11] Patent Number: 4,679,015

[45] Date of Patent: Jul. 7, 1987

[54] FERROMAGNETIC RESONATOR

[75] Inventors: Yoshikazu Murakami, Kanagawa; Seigo Ito, Tokyo; Hiromi Okamoto, Kanagawa; Hideo Tanaka, Miyagi, all of Japan

[73] Assignee: Sony Corporation, Tokyo, Japan

[21] Appl. No.: 844,984

[22] Filed: Mar. 27, 1986

[30] Foreign Application Priority Data

Mar. 29, 1985 [JP] Japan ..... 60-65874

[51] Int. Cl.[4] ..... H01P 7/08

[52] U.S. Cl. ..... 333/219; 333/204; 333/24.1

[58] Field of Search ..... 333/219, 235, 222, 223, 333/204, 205, 24.1

[56] References Cited

U.S. PATENT DOCUMENTS 4,547,754 10/1985 Murakami et al. ..... 333/219

*Primary Examiner*—Eugene R. LaRoche

*Assistant Examiner*—Seung Ham

*Attorney, Agent, or Firm*—Hill, Van Santen, Steadman & Simpson

[57] ABSTRACT

A ferromagnetic resonator comprises a nonmagnetic substrate, a ferrimagnetic thin film element formed on a major surface of the nonmagnetic substrate, a strip line for example formed on another major surface of the nonmagnetic substrate and electromagnetically coupled to the ferrimagnetic thin film element, a conductive wall facing the strip line and spaced therefrom a predetermined distance, an end of the strip line being connected by the conductive wall to ground potential and a bias magnetic field source applying a D.C. magnetic field to the ferrimagnetic thin film perpendicular to the major surface thereof. Such an arrangement enables a drastic reduction in the effective dielectric constant of the transmission lines, whereby a filter with a high center frequency of the order of at least ten gigahertz can be achieved despite the short type structure.

2 Claims, 13 Drawing Figures

FERROMAGNETIC RESONATOR

BACKGROUND OF THE INVENTION

The present invention relates to a ferromagnetic resonator utilizing ferromagnetic resonance in a ferrimagnetic thin film, and more particularly to a filter device utilizing ferromagnetic resonance and suitable for use in a microwave integrated circuit (hereinafter referred to as a MIC).

There has been proposed a filter device utilizing a ferrimagnetic thin film of yttrium iron garnet (YIG) formed on a gadolinium-gallium garnet (GGG) substrate by the liquid phase epitaxial (LPE) growth process, as disclosed in U.S. Pat. No. 4,547,754 which is assigned to the same assignee as the present invention. Filter devices of this type using YIG thin film elements attract attention for use as MIC filters because of the high Q values of their resonance characteristics in the microwave frequency band, compact structure, and suitability for mass production through the selective patterning process by LPE and lithography.

An MIC band-pass filter using a YIG thin film may be constructed generally as shown in FIG. 1, for example, wherein a dielectric substrate 1 made of alumina or the like has a first main surface coated with a ground conductor 2 and has a second main surface coated with first and second microstrip lines disposed in a parallel arrangement to form input and output transmission lines 3 and 4. As shown in the aforementioned U.S. patent, both ends of each of the strip lines 3 and 4 have heretofore been connected to the ground conductor 2 by respective connecting conductors. Each ends 3*a* and 4*a* of input and output lines 3 and 4 is connected to input and output circuits respectively. Adjacent the second main surface of the substrate 1 are first and second magnetic resonance elements, i.e., YIG thin film elements 7 and 8, which are electromagnetically coupled with the respective microstrip lines 3 and 4. These YIG thin film elements 7 and 8 are produced by forming a YIG thin film on a main surface of a GGG substrate 9 by the above-mentioned thin film forming technique and patterning the film into circular lands by a selective etching technique, photolithography, for example. Extending between the first and second YIG thin film elements 7 and 8 is a third microstrip line 10 for providing electromagnetic coupling between the elements. The coupling transmission line 10 is formed on a second main surface of the substrate 9, with both ends of transmission line 10 being connected to the ground conductor 2 by connecting conductors 11 and 12.

MIC filter devices constructed as described in the above-mentioned U.S. patent are restricted to relatively low center frequencies of several GHz at most due to two major reasons as follows. The first reason is that the YIG thin film elements need to be placed at positions where the magnetic field is maximum for the purpose of magnetic coupling with each microstrip line; however this condition is not met for relatively high center frequencies. In particular, the magnetic field is maximum at the grounding end of the microstrip line and minimum at the position $\lambda g/4$ (where $\lambda g$ is the propagation wavelength) away from the maximum position, and therefore each YIG thin film element needs to be disposed as near to the grounding end of the microstrip line as possible for good coupling at relatively high center frequencies. The propagation wavelength $\lambda g$ is expressed in terms of the effective dielectric constant $\epsilon_{eff}$ determined from the dielectric constants of the dielectric substrate 1 and GGG substrate 9 and the shape of the microstrip lines as, $$\lambda g = \lambda o/\sqrt{\epsilon_{eff}} \quad (1)$$

Accordingly, the propagation wavelength $\lambda g$ is reduced to $1/\sqrt{\epsilon_{eff}}$ of the free space wavelength $\lambda o$. On the other hand, each YIG thin film element needs a finite volume for substantial magnetic coupling with the associated microstrip line; e.g., for a thickness of 20–30 $\mu$m, the element diameter should be around 2 mm; and at a high frequency of several GHz even if the YIG element is disposed at the grounding end of the microstrip line the distance between this position and the YIG element center is comparable with $\lambda g/4$, resulting virtually in the disposition of the YIG thin film elements at locations of weaker magnetic field, and accordingly resonant high-frequency coupling efficiency between the YIG thin film elements and the microstrip lines is reduced for relatively high resonant frequencies, and the insertion loss between the filter input and the filter output at the resonance frequency (which should be low) becomes relatively high. The second reason is that the intersections of the input and output microstrip lines and the microstrip line for linking the YIG thin film elements are not located at the grounding end portions where the electric field is minimal, but instead the distance between the intersections and the respective grounding ends approaches $\lambda g/4$ at which the electric field is maximal as the operating frequency goes higher, which causes the capacitive coupling to increase, so that the isolation characteristics are deteriorated significantly at higher frequencies. FIGS. 2 and 3 show the insertion loss of the patented filter device as a function of the operating frequency, and it is apparent that the input/output coupling undesirably increases at frequencies above 4.5 GHz. Namely, the device propagates the input signal irrespective of the resonance of the YIG thin film elements, and does not function as a filter.

With the intention of overcoming the above-mentioned deficiencies, the applicant of the present invention has proposed a filter device in Japanese Patent application No. 59-187079, in which the microstrip lines each have one of their ends open with YIG thin film elements 7 and 8 being disposed at positions distant from open ends by an odd multiple of $\lambda g/4$. A filter of this construction can have a high center frequency above several GHz as shown in FIG. 4, but it is suitable only for a fixed band or narrow band-width variable filter because of the narrow band width of the high-frequency coupling efficiency and isolation characteristics, and a broad band variable filter cannot be realized. FIG. 4 shows as a measurement result the isolation characteristics of this filter device for different input frequencies and indicates that an effective filtering function with an isolation of 40 dB or more is accomplished in a narrow band of about three gigahertz between 11.75 and 14.75 GHz.

SUMMARY OF THE INVENTION

Accordingly it is an object of the present invention to provide an improved ferromagnetic resonator.

It is another object of the present invention to provide a ferromagnetic resonator operable at high frequency.

It is a further object of the present invention to provide a ferromagnetic resonator suitable for use as a variable filter device having a wide frequency band.

According to one aspect of the present invention there is provided a ferromagnetic resonator comprising a nonmagnetic substrate, a ferrimagnetic thin film element formed on a major surface of said nonmagnetic substrate, a strip line electromagnetically coupled to said ferrimagnetic thin film element, a conductive wall of ground potential facing said strip line, and spaced at a predetermined distance therefrom, an end of said strip line being connected to said conductive wall of ground potential, and bias magnetic field means applying a D.C. magnetic field to said ferrimagnetic thin film perpendicular to said major surface thereof.

Other objects, features and advantages of the present disclosure will be apparent from the following detailed description taken in connection with the accompanying sheets of drawings, and from the claims appended hereto.

DESCRIPTION OF THE PREFERRED EMBODIMENTS

Figure 5:
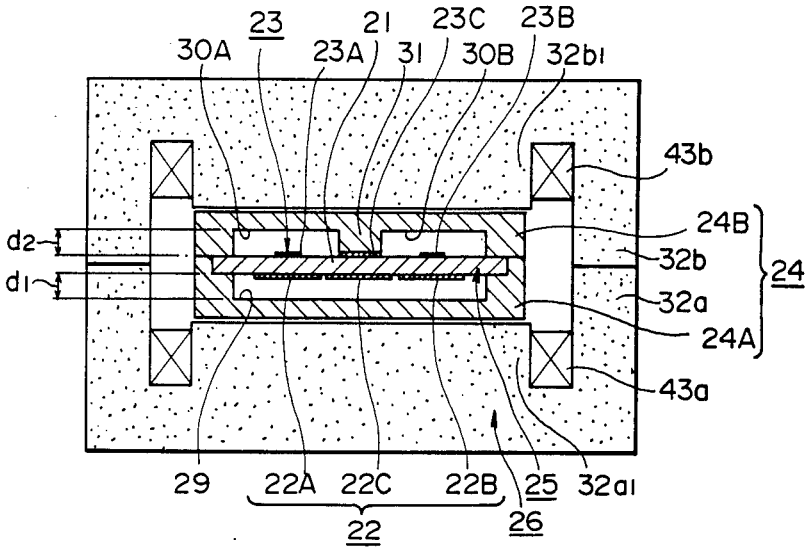
FIGS. 5, 6 and 7 are structural views of a ferromagnetic resonator embodying the present invention.

The inventive ferromagnetic resonator is of a "short" type having the microstrip lines being grounded at the ends, and constructed with the intention of lowering the effective dielectric constant $\epsilon_{eff}$ of its transmission system down to almost unity by the utilization of a so called suspended substrate strip line configuration or an inverted microstrip line configuration. In FIG. 5 showing the structural arrangement of this invention, the device main body 25 including a nonmagnetic substrate e.g., a GGG substrate, 21, ferrimagnetic thin film element, e.g., YIG magnetic thin film elements, 22 formed on one main surface of the nonmagnetic substrate 21, and strip lines 23 in electromagnetic coupling with the ferrimagnetic thin film elements 22, is further provided with conductive walls 24 which confront the strip lines 23 with a certain spacing formed therebetween and which ground one end of each of the strip lines, and a means 26 for applying a d.c. bias magnetic field to the ferrimagnetic thin film elements, i.e., YIG magnetic thin film elements, 22, so that transmission lines are formed in the structure of a suspended substrate strip line configuration or an inverted microstrip line configuration.

Figure 6:
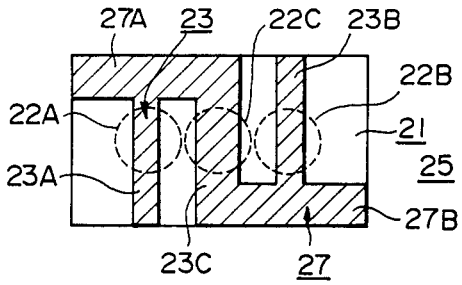
Figure 7:
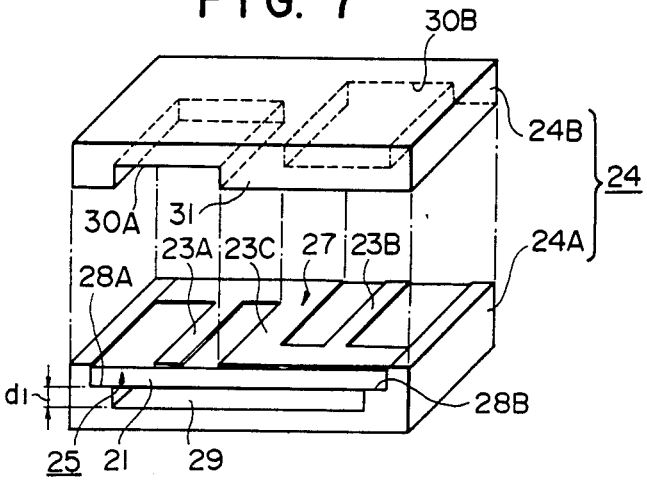

An embodiment of this invention will be described with reference to FIGS. 5, 6 and 7, showing a cross-sectional view, a plan view of the main body 25 and a partially-exploded perspective view of the device, respectively. This embodiment employs the suspended substrate strip line structure, and the conductive walls 24 are constructed to form a shielding case which encloses the device main body 25. The device main body 25 includes a GGG nonmagnetic substrate 21, and its one main surface has first and second YIG magnetic thin film elements 22A and 22B with a certain spacing from each other and a third YIG magnetic thin film element 22C disposed between the YIG elements 22A and 22B for providing the magnetic coupling for them. These magnetic thin film elements 22A, 22B and 22C may have a groove in the periphery on one main surface of the magnetic thin film or may have a smaller thickness in the central portion than the peripheral portion so as to suppress the spurious response, as disclosed in the aforementioned U.S. Pat. No. 4,547,754. On the main surface of the GGG nonmagnetic substrate 21 opposite to that where the YIG magnetic thin film elements 22A, 22B and 22C are formed, there is formed a pattern of conductive material providing a conductor 27. The conductor 27 has sections providing first and second microstrip lines, i.e., an input strip line 23A and output strip line 23B disposed in parallel to each other and extending across the first and second YIG magnetic thin film elements 22A and 22B, respectively, a central ground pattern 23C located between and in parallel to the strip lines 23A and 23B and extending across the third central YIG magnetic thin film element 22C and connected at its opposite ends with the strip lines 23A and 23B, and grounding ends 27A and 27B engaging the grounded surface of part 24B and connecting the strip line 23A to one end of the central ground pattern 23C and the strip line 23B to the other end of the central ground pattern 23C.

The ground conductive walls 24 which are at ground potential comprise a first conductive wall section 24A and a second conductive wall section 24B as shown in the partly-exploded perspective view of FIG. 7. The first conductive wall section 24A has ledges 28A and 28B for supporting the GGG nonmagnetic substrate 21 at the ends of substrate 21 adjacent to the YIG magnetic thin film elements 22A and 22B, and these ledges 28A and 28B are separated by an interposed recess 29. By being placed on the ledges 28A and 28B the GGG nonmagnetic substrate 21 confronts the inner surface of the conductive wall section 24A with a certain spacing d1 being provided by the recess 29. Another conductive wall section 24B has recesses 30A and 30B in portions confronting the first and second microstrip lines 23A and 23B, i.e., the locations of the first and second YIG magnetic thin film elements 22A and 22B (not shown in FIG. 7). The structure is dimensioned such that when both conductive wall sections 24A and 24B are put together with the substrate 21 interleaved therebetween, a protruding section 31 between the recesses 30A and 30B comes into contact with the central ground pattern 23C of the conductive pattern of conductor 27 so as to establish an electrical connection therebetween, while at the same time the protruding section 31 and the central ground pattern 23C in combination provide isolation between the input and output lines 23A and 23B, and the recesses 30A and 30B provide a certain spacing d2 between the GGG nonmagnetic substrate 21 and the confronting inner surfaces of the conductive wall section 24B.

The d.c. bias magnetic field application means 26 is constructed in such a way that a pair of cores **32*a* and 32*b* have their central magnetic poles 32a1 and 32b1** confronting each other and disposed at opposite sides of the device main body 25, with windings 43*a* and 43*b* being placed on the respective central magnetic poles 32a1 and 32b1, so that a d.c. bias magnetic field is created between the poles.

According to the inventive resonator structure described above, the transmission lines are constructed to form a so-called suspended substrate strip line structure, which allows a smaller effective dielectric constant $\epsilon_{eff}$ despite the use of the GGG nonmagnetic substrate 21. Typically, using a GGG substrate of 0.4 mm in thickness for the nonmagnetic substrate 21, with spacings d1 and d2 of 0.6 mm each being provided between the upper and lower surfaces of the GGG substrate 21 and the conductive walls 24, an effective dielectric constant of 2.2 is achieved for a 50-ohm strip line of 1.25 mm in width. When the YIG magnetic thin film elements 22A and 22B are placed near the grounding ends 27A and 27B of the strip lines 23A and 23B to meet the condition $L \leqq \lambda g/4$ where L denotes the distance from the center of each YIG element to the respective grounding end, this condition is satisfied up to a frequency as high as 25 GHz for the YIG magnetic thin film elements 22. Accordingly, this structure retains the efficiency of coupling between the input and output lines and the YIG magnetic thin film elements, i.e., the YIG resonator, up to such a high frequency, whereby a broad band variable filter operative at high frequencies can be realized.

Figure 1:
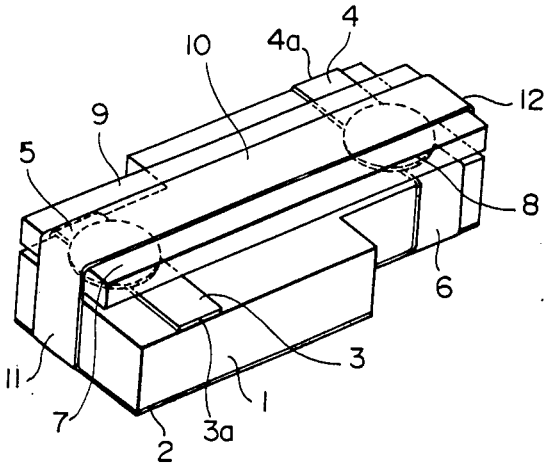
FIG. 1 (PRIOR ART)
FIG. 1 is a perspective view of a filter device utilizing ferromagnetic resonance and having input and output microstrip lines constructed as taught in U.S. Pat. No. 4,547,754.
Figure 2:
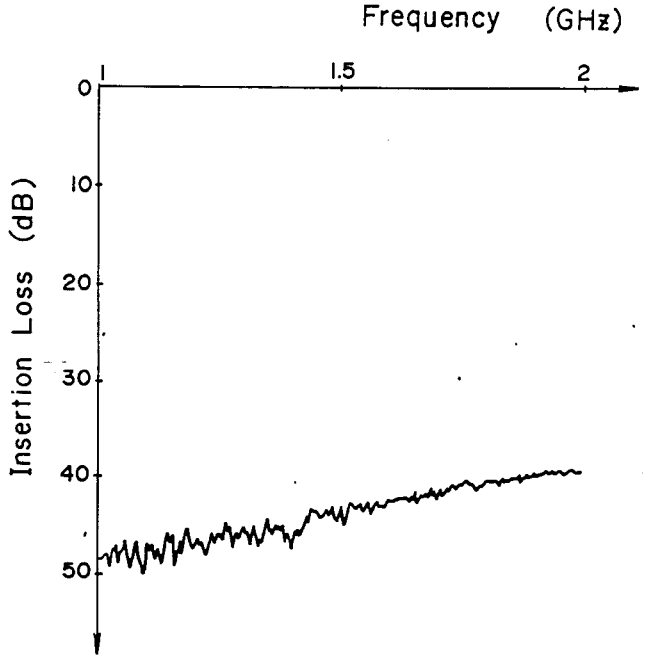
FIGS. 2 and 3 are characteristic graphs showing insertion loss as a function of input frequency for the filter device of U.S. Pat. No. 4,547,754.
Figure 3:
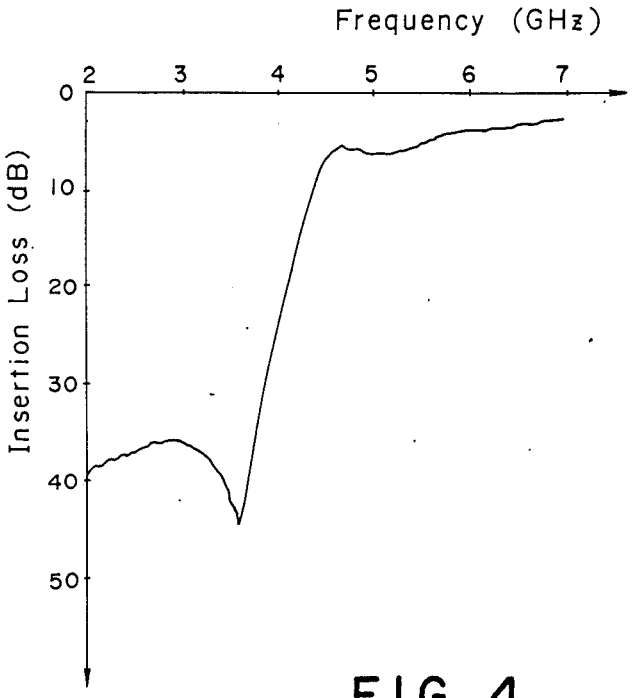
Figure 4:
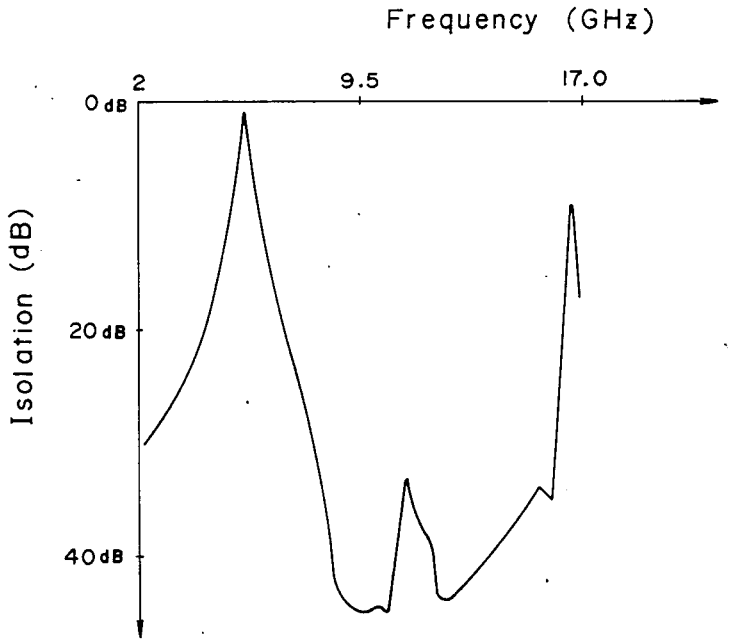
FIG. 4 is a plot of the isolation provided by the modified filter device wherein YIG discs are provided at positions distant from open ends by an odd multiple of $\lambda g/4$ as a function of input frequency.

The filter device described in connection with FIG. 1 uses a GGG substrate 9 of high dielectric constant $\epsilon_r = 13$, and therefore even by the combinational use of a dielectric substrate 1 having a small dielectric constant, the effective dielectric constant $\epsilon_{eff}$ cannot be made sufficiently small. For example, using an alumina sheet of 1.27 mm in thickness ($\epsilon_r = 10$) as a dielectric substrate 1 and a GGG substrate 9 of 0.4 mm in thickness, the effective dielectric constant $\epsilon_{eff}$ of the microstrip lines with a 50-ohm characteristic impedance is 8.6 for the line on the alumina substrate 1 and 7.3 for the line on the GGG substrate 9. In another example using a quartz substrate ($\epsilon_r = 3.8$) of 0.5 mm in thickness as a dielectric substrate 1 and a GGG substrate 9 of 0.4 mm in thickness, the effective dielectric constant $\epsilon_{eff}$ of the 50-ohm microstrip lines is 4.9 for the line on the quartz substrate and 5.1 for the line on the GGG substrate.

The inventive filter structure using direct coupling for the YIG resonator, i.e., the YIG magnetic thin film elements, enables perfect isolation up to extremely high frequencies owing to the absence of a strip line for linking the resonator elements, and because of the high-frequency isolation between the input and output strip lines provided by the protruding section 31 between the recesses 30A and 30B in the conductive walls 24 and the central ground pattern 23C of the conductive pattern 27, and also the isolation provided by the conductive walls 24 surrounding the device main body 25.

Figure 8:
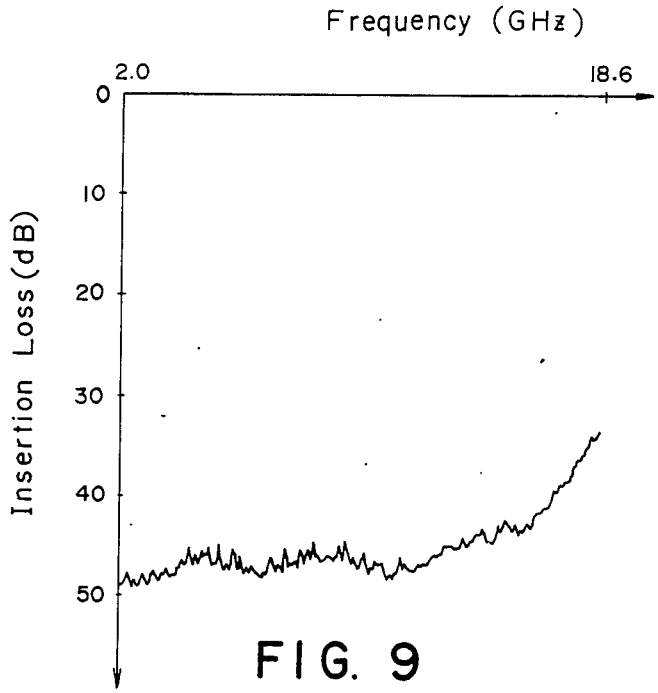
FIGS. 8 and 9 are characteristic graphs for resonator of FIGS. 5, 6 and 7.
Figure 9:
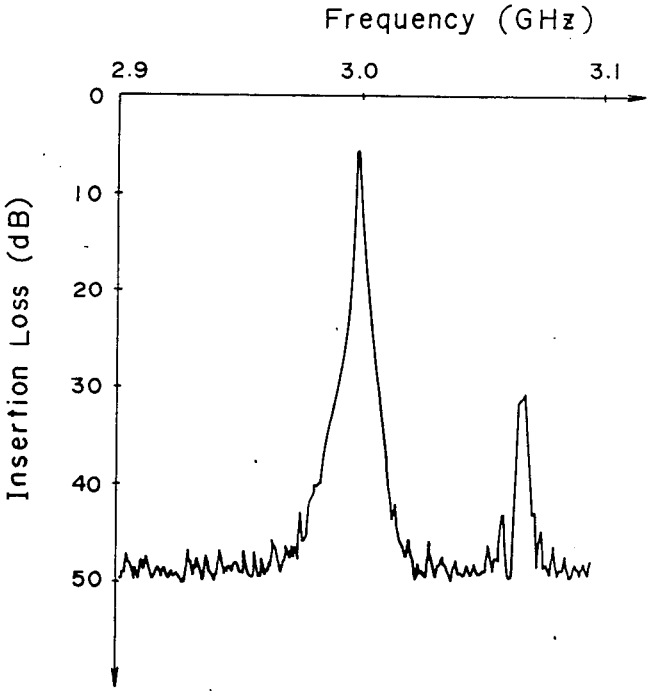

FIG. 8 is graph showing the insertion loss plotted against the frequency for the filter device described using FIGS. 5–7, indicating an isolation of 40 dB or more up to a frequency as high as 17 GHz. FIG. 9 shows the characteristics of the filter with a d.c. bias magnetic field being applied so that the center frequency is set to 3 GHz. The center frequency can be varied through the adjustment of the magnetic field.

Figure 10:
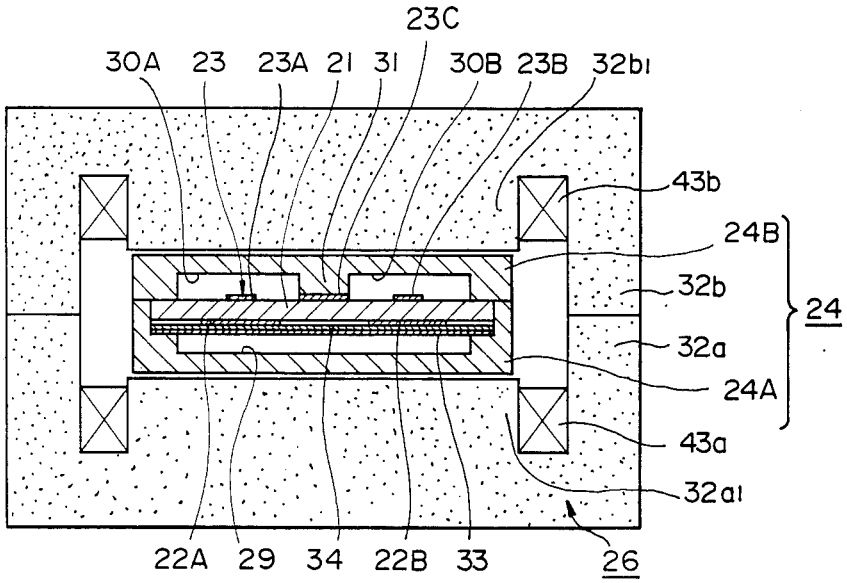
FIGS. 10, 11, 12 and 13 are structural views used to explain other embodiments of this invention.
Figure 11:
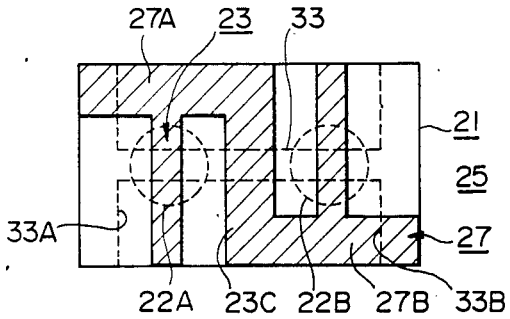

Although the foregoing embodiment employs direct coupling for the YIG resonator, the present invention is not limited to this, but alternatively for example first and second YIG magnetic thin film elements 22A and 22B are formed on one main surface of a GGG substrate 21 as shown in FIGS. 10 and 11, so that the elements are coupled by a third microstrip line 33 in the same manner as described in connection with FIG. 5. In this case, the third microstrip line 33 can be formed on a base 34 of polyester film, for example, so that the third microstrip line 33 on the polyester film confronts the first and second YIG magnetic thin film elements 22A and 22B on the GGG nonmagnetic substrate 21. The third microstrip line 33 may be provided at both of its ends with grounding ends 33A and 33B, which are interposed together with the nonmagnetic substrate 21 between the first and second conductive wall sections 24A and 24B and which ends 33A and 33B are in contact with the first conductive wall section 24A of the conductive walls 24 of ground potential. The remaining arrangement of FIGS. 10 and 11 is common to that of FIGS. 5 and 6, and parts are designated by the same reference characters, so that the explanation thereof need not be repeated.

This modified arrangement also meets the condition that the YIG magnetic thin film elements are placed in the vicinity of the grounding ends of the strip lines for frequencies up to as high as 25 GHz, and high-efficiency coupling between the strip lines and YIG magnetic thin film elements can be retained. The distance from each of two intersections between the first and second microstrip lines 22A and 22B and the third microstrip line 33 to the grounding end becomes equal to $\lambda g/4$ at a frequency of 12.5 GHz and although the frequency with satisfactory isolation is not so high as compared with the arrangement shown in FIGS. 5 to 7, a significant improvement is achieved when compared with a conventional filter device.

Although the foregoing embodiment has the formation of YIG magnetic thin film elements 22 (22A and 22B) on one surface of the GGG nonmagnetic substrate 21 and the conductive pattern 27 such as the first and second strip lines on the other surface, an alternative arrangement is that the conductive pattern 27 is formed on a film made of polyester or the like provided separately from the nonmagnetic substrate 21, and then the film with the formation of conductive pattern is placed over the GGG nonmagnetic substrate 21.

Figure 12:
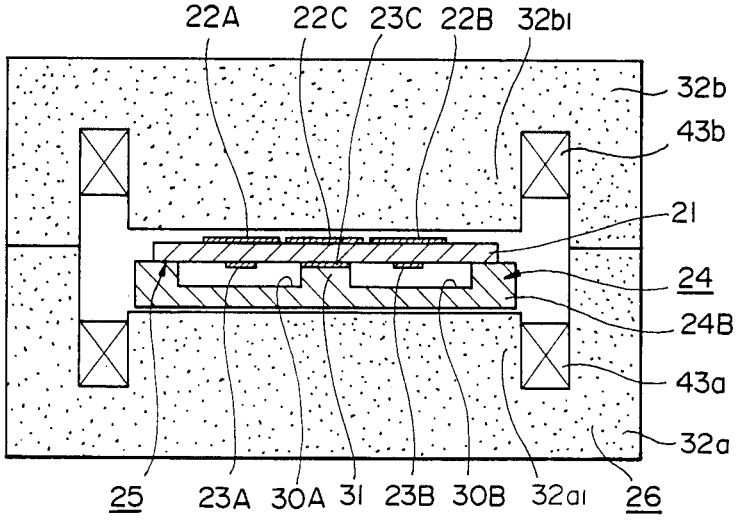
Figure 13:
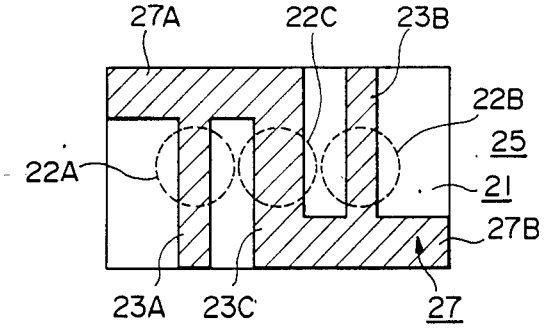

Although the suspended substrate strip line structure has been described in the above embodiments, the present invention can be applied equally to the inverted microstrip line structure. FIGS. 12 and 13 show a cross-sectional view and a plan view of the device for the latter case. In the figures, components identical to those shown in FIGS. 5 and 6 are designated by common reference symbols so that explanation thereof need not be repeated. The new arrangement has part of the conductive walls 24, i.e., the conductive wall section 24A, removed, and an open wall structure is formed.

In this structure with a spacing of 0.4 mm produced by the recesses 30A and 30B in the ground potential conductive walls 24 with respect to the surface of the GGG nonmagnetic substrate 21 on the side of the microstrip line, the 50-ohm line has a width of 1.26 mm and an effective dielectric constant $\epsilon_{eff}$ of as small as 1.9. Also in this case, however, when the cores 32*a* and 32*b* of the bias magnetic field source are made of material having a shielding effect, the overall structure becomes virtually identical to the suspended substrate microstrip line structure.

The YIG magnetic thin film elements 22A, 22B and 22C formed on a main surface of the GGG nonmagnetic substrate can be produced concurrently by growing an YIG thin film epitaxially on the entire main surface and thereafter patterning the film into the lands by photolithography, so that this embodiment is suitable for the volume production.

As described above, the present invention enables a drastic reduction in the effective dielectric constant $\epsilon_{eff}$ of the transmission lines, whereby a filter with a high center frequency of the order of GHz can be achieved despite the "short" type structure.

According to the present invention, it is also possible to construct a broad band variable filter having a variable center frequency from a low frequency to a high frequency of the order of GHz through the provision of a variable bias magnetic field source.

While several preferred embodiments have been illustrated and described in detail, it will be apparent to those skilled in the art that many changes and modifications may be made without departing from the disclosed invention in its broader aspects; and it is intended that the appended claims cover all such changes and modifications as fall within the true spirit and scope of the contributions to the art made hereby.

What is claimed is:

1. A ferromagnetic resonator comprising;

a nonmagnetic substrate, a ferrimagnetic thin film element formed on a major surface of said nonmagnetic substrate, a strip line disposed at another major surface of said nonmagnetic substrate and electromagnetically coupled to said ferrimagnetic thin film element, a conductive wall of ground potential facing said strip line, and spaced at a predetermined distance therefrom, an end of said strip line being connected to said conductive wall of ground potential, and bias magnetic field means applying a D.C. magnetic field to said ferrimagnetic thin film perpendicular to said major surface thereof.

2. A filter device utilizing ferromagnetic resonance comprising:

a nonmagnetic substrate, first, second, and third ferrimagnetic thin film elements formed on a major surface of said nonmagnetic substrate, a first strip line disposed at another major surface of said nonmagnetic substrate and electromagnetically coupled to said first ferrimagnetic thin film element, a second strip line disposed at said another major surface of said nonmagnetic substrate and electromagnetically coupled to said second ferrimagnetic thin film element, a conductive wall of ground potential facing each of said first and second second strip lines and spaced at a predetermined distance therefrom, an end of said first strip line being connected to an input circuit, and another end of said first strip line being terminated at said conductive wall of ground potential, an end of said second strip line being connected to an output circuit, and another end of said second strip line being terminated at said conductive wall of ground potential, said third ferrimagnetic thin film element being provided between said first and second ferrimagnetic thin film elements and magnetically coupled to said first and second ferrimagnetic thin film elements, and bias magnetic field means applying a D.C. bias magnetic field to said ferrimagnetic thin film perpendicular to said major surface thereof.

* * * * *